US005609928A

United States Patent [19]

Yedlin et al.

[11] Patent Number: 5,609,928

[45] Date of Patent: Mar. 11, 1997

[54] DECORATIVE ORNAMENT AND METHOD OF MAKING SAME

[76] Inventors: Monte A. Yedlin; Mary M. Yedlin, both of 1441 Virginia Ave., Glendale, Calif. 91202-1531

[21] Appl. No.: 610,897

[22] Filed: Mar. 5, 1996

[51] Int. Cl.[6] ..... D04D 7/10

[52] U.S. Cl. ..... 428/5; 428/4; 428/7; 428/18; 156/187

[58] Field of Search ..... 428/5, 4, 7, 18, 428/26, 20; 156/187; 223/46

[56] References Cited

U.S. PATENT DOCUMENTS

| | | | |
|---|---|---|---|
| 109,720 | 11/1870 | Darnall | 428/4 |
| 360,000 | 3/1887 | Darnall | 428/4 |
| 1,896,060 | 1/1933 | Colby | 428/4 |
| 2,226,349 | 12/1940 | Royle | 41/15 |
| 2,810,977 | 10/1957 | Barry | 41/10 |
| 3,041,767 | 7/1962 | Ranoha et al. | 41/15 |
| 3,056,223 | 10/1962 | Crane | 41/15 |
| 3,133,851 | 5/1964 | Reukauf | 161/22 |
| 3,174,886 | 3/1965 | Miscovich | 156/72 |
| 3,457,134 | 7/1969 | Karkoska | 161/9 |
| 4,201,806 | 5/1980 | Cole | 428/4 |

*Primary Examiner*—Alexander Thomas
*Attorney, Agent, or Firm*—Jack C. Munro

[57] ABSTRACT

A decorative ornament that is constructed generally in the shape of a bow, flower or tree which is formed by wrapping a first section of sheet material on a rigid core. The first section includes a plurality of spaced apart cuts which extend between a solid upper border and a solid lower border. When the first section is folded over upon itself with the borders abutting, the material located between the cuts each form a loop. The first section is basically in the shape of a truncated cone with the left edge being of a short length and the right edge being of a longer length. The first section is to be overlapped with the borders abutting and then wrapped on the core. Wrapping in a direct overlapping arrangement will produce one type of ornament and wrapping longitudinally along the core will produce another type of ornament. Also, different types of decorative ornaments are produced when the wrapping starts with the short edge or the long edge. There may be added a second section of material that is basically the shape of the first section when it is folded upon itself. The second section of material includes a plurality of spaced apart cuts forming a plurality of strips which are mounted in a cantilevered fashion from a lower border. This second section is to be placed in juxtaposition with the first section prior to being wound on the core. With the addition of the second section a still further different type in appearance of decorative ornament will be produced.

16 Claims, 4 Drawing Sheets

DECORATIVE ORNAMENT AND METHOD OF MAKING SAME

BACKGROUND OF THE INVENTION

1) FIELD OF THE INVENTION

The field of this invention relates to decorative ornaments that are to be usable as bows in gift wrapped packages, holiday ornaments, artificial flowers, decorative displays and other similar usages.

2) DESCRIPTION OF THE PRIOR ART

Decorative ornaments for use in gift wrapping packages are well known. Normally such ornaments are constructed of a ribbon and are arranged in a plurality of loops that extend from a central core normally called a bow. The problem with bows at the present time is that such are all of the same type. It would be desirable to produce different types of bows that have different appearances.

SUMMARY OF THE INVENTION

The subject invention comprises a decorative ornament in the shape of a bow which is formed from a trapezoidal shaped section of flexible sheet material which has parallel side edges of different lengths and non-parallel upper and lower edges of the same length. Desirable material for construction for this trapezoidal shaped section would be plastic and/or paper, although other sheet material type of material could be used. Placed within the section and extending between the upper and lower edges are a plurality of parallel cuts. These cuts terminate at a solid border at both the upper edge and lower edge. The trapezoidal shaped section is then folded over upon itself with the borders in abutting connection. This trapezoidal shaped section is then to be wound on a rigid core or tube with generally a cylindrically shaped rod being preferred. The winding can be accomplished in a straight overlapping arrangement which will result in the production of a decorative ornament resembling a bow or flower. Also, the winding can be accomplished longitudinally along the core which will produce a different shape of decorative ornament resembling a tree or flower. If the winding is started with the short edge of the trapezoidal shaped section, one configuration of bow will be produced. If the winding starts at the long edge of the trapezoidal shaped section, a different configuration of bow will be produced. A second section of sheet material could be placed in juxtaposition with the first section as it is wound on the core. The second section includes a similar series of cuts but there is only a single border at the bottom edge. In between the cuts are formed strips with these strips having free ends at the upper edge. The shape of the second section is to be substantially identical to the shape of the first section when it is folded over upon itself. Winding of the second section with the first section will again produce a different configuration of bow. Other decorations could be utilized in conjunction with the decorative ornament with these decorations to be located centrally of the ornament.

DETAILED DESCRIPTION OF THE PREFERRED EMBODIMENTS

Figure 1:
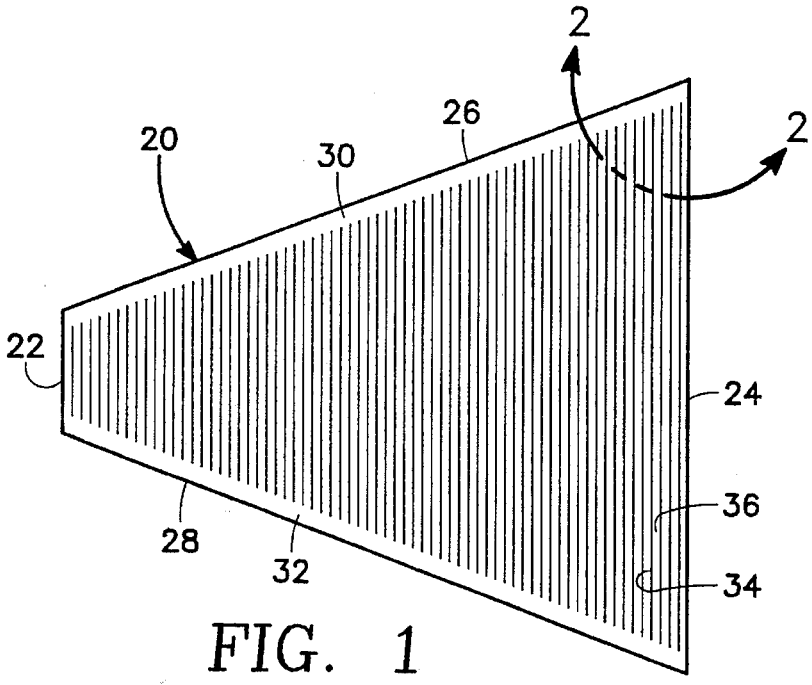
FIG. 1 is a top plan view of the trapezoidal shaped sheet material which is utilized as the primary element in the construction of the ornament of the present invention.
Figure 2:
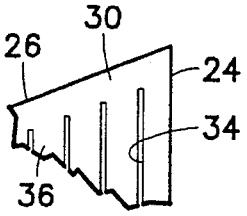
FIG. 2 is an enlarged corner section taken along line 2—2 of FIG. 1 showing in more detail the construction of the trapezoidal shaped sheet material section.
Figure 4:
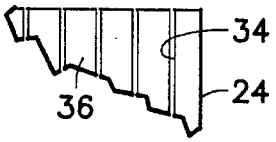
FIG. 4 is an enlarged view of a corner of the section shown in FIG. 3 taken along line 4—4 of FIG. 3.

Referring particularly to the drawings there is shown in FIG. 1 the thin sheet material trapezoidal shaped section 20.

This trapezoidal shaped section 20 includes a left edge 22 and a right edge 24. Edges 22 and 24 are located parallel to each other. Edge 22 is shorter in length than edge 24. In one embodiment the edge 24 would be approximately eight inches long with edge 22 being about one and five-eighths inches long. Typical material for the section 20 could comprise flexible plastic, polyester, polypropylene including blown polypropylene ribbon material, vinyl, papers, and laminates thereof such as combining paper and polypropylene. The materials can be tinted, printed, metallized, embossed, holographic and similar processes. Thicknesses would normally comprise between one mil to five mil. Section 20 includes an upper edge 26 and a lower edge 28 which are oblique. Directly adjacent the upper edge 26 is a border 30. Directly adjacent the lower edge 28 is a border 32. The upper edge 26 and the lower edge 28 are the same length.

Formed in the section 20 in a direction transverse to the borders 30 and 32 are a plurality of cuts 34. The cuts 34 are located parallel to each other and are actually so thin that for all practical purposes, when the section 20 is laid flat as in FIG. 1, it would appear that the section 20 is solid. Between the cuts are formed strips 36. These strips 36 are rigid but readily deflectable and can be called flimsy. These strips 36 are normally about an eighth of an inch wide but can be made narrower or wider.

Figure 3:
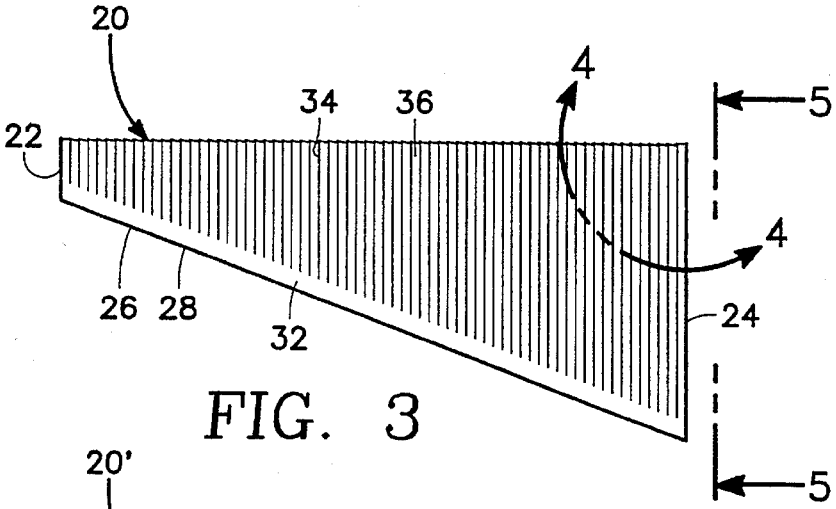
FIG. 3 is a top plan view of the trapezoidal shaped section when it is folded over upon itself in order to produce the plurality of loops contained within the trapezoidal shaped section.
Figure 5:
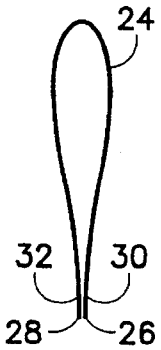
FIG. 5 is an end view of the trapezoidal shaped section taken along line 5—5 of FIG. 3.

The section 20 is then to be folded over upon itself as is shown in FIG. 3. The borders 30 and 32 are aligned with each other. Because of the folding over, strips 36 become loops. Normally there will be in place an adhesive between the borders 30 and 32 to secure them together so as to maintain the section 20 in the folded over configuration shown in FIG. 3.

Figure 6:
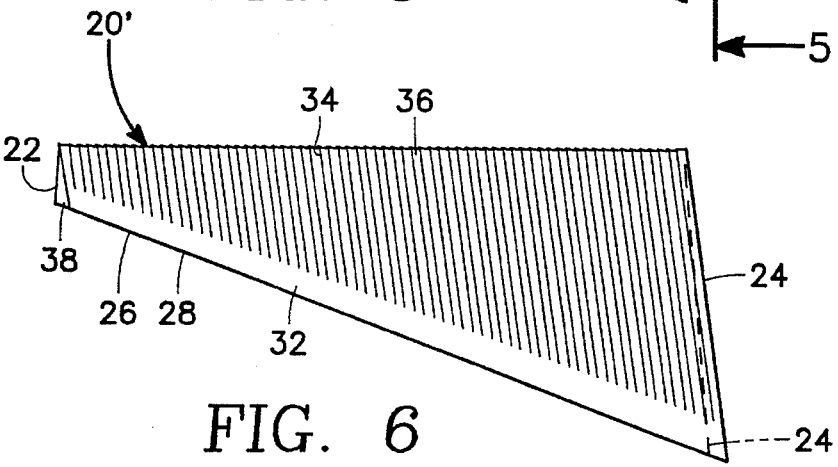
FIG. 6 is a view similar to FIG. 3, but where the upper and lower borders of the trapezoidal section have been purposefully misaligned to produce a different appearing decorative ornament than what would be produced by the trapezoidal shaped section of FIG. 3 where the borders are aligned.

Referring particularly to FIG. 6, there is shown a folded over configuration but where the borders 30 and 32 are slightly misaligned forming a gap 38. The gap 38 at the left edge 22 is equal to the gap at the right edge 24. It has been discovered that by utilizing of the folded over misaligned section, as shown in FIG. 6, a somewhat different decorative ornament having a spiral appearance, will be produced with the section 20' of FIG. 6. It is to be understood that the borders 30 and 32 might be adhesively secured together with the section 20'.

A rigid core 40 is to be used. This core 40 would normally be cylindrical and about one quarter of an inch in diameter, but a smaller or larger diameter could be used. In actual practice the decorative ornaments will be produced on the core 40 which would be part of a tube or dowel, possibly several feet long. Once the ornament is produced on the core 40, the core 40 could then be cut to any desired length. The core 40 could be cut directly adjacent the ornament or could be cut some distance from the ornament.

Figure 7:
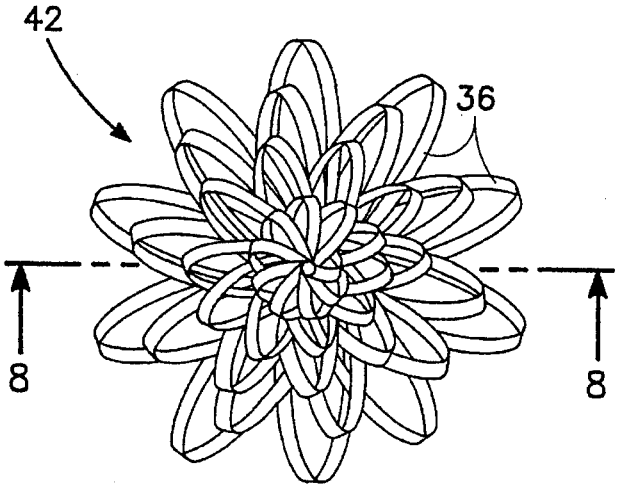
FIG. 7 is a top plan view of a bow type of decorative ornament that would be produced utilizing the trapezoidal shaped section in the configuration of FIG. 3 upon being wrapped in a directly overlapping relationship on a rigid core.
Figure 8:
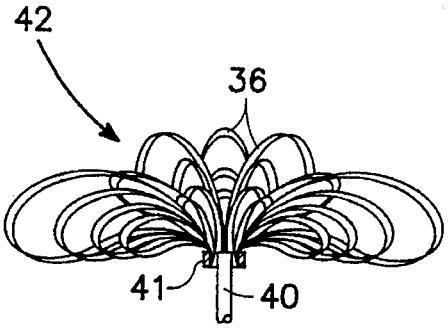
FIG. 8 is a cross-sectional view taken along line 8—8 of FIG. 7.
Figure 16:
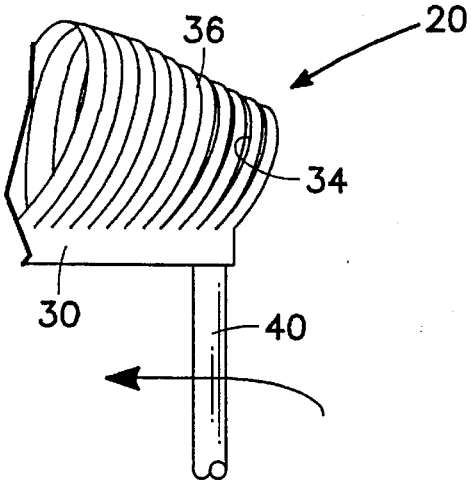
FIG. 16 is a view depicting winding of the section shown in FIG. 3 in a directly overlapping arrangement which will produce the bows of FIGS. 7 and 9.

Referring particularly to FIGS. 7 and 8, there is shown a decorative ornament which is referred to as a standard bow 42. The borders 30 and 32 are wound on the core 40 starting with the left edge 22. At the left edge 22 there is the shortest of the loops with the right edge 24 producing the longest of the loops. This winding procedure is depicted generally in FIG. 16. The winding of the section 20 on the core 40 is accomplished in a direct overlapping relationship with the borders 30 and 32 being wound several revolutions on top of each other. The actual direction of winding will be transverse to the longitudinal center axis of the core 40. The result produced will be the standard bow 42. The completed winding is held in place by a collar 41.

Figure 9:
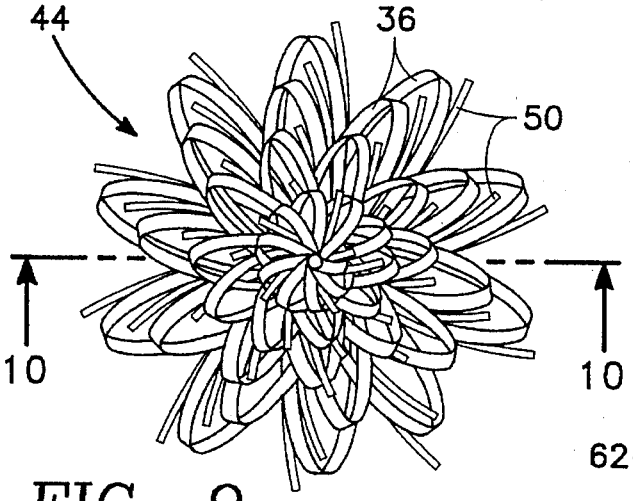
FIG. 9 is a view similar to FIG. 7 but where there has been added a second section of material which is a single layer with the cuts producing strips that have free outer ends.
Figure 10:
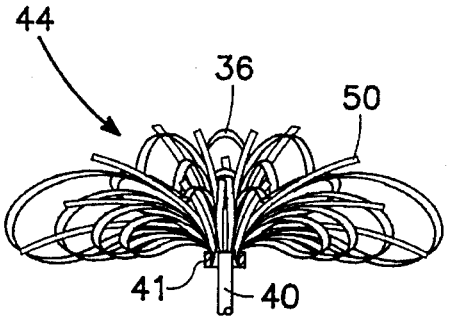
FIG. 10 is a cross-sectional view taken along line 10—10 of FIG. 9.
Figure 20:
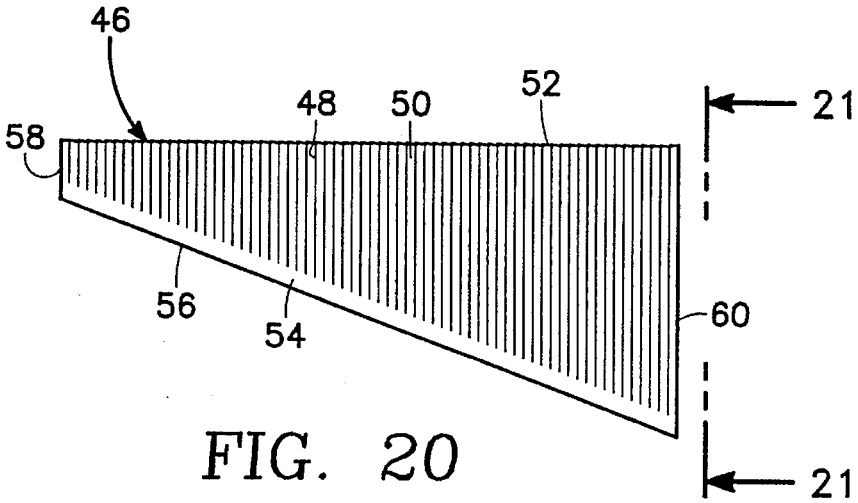
FIG. 20 is a view of an additional section in the form of a single layer the same size as the folded over section.
Figure 21:
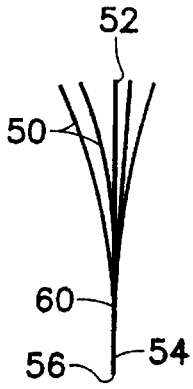
FIG. 21 is a side view of the additional section taken along line 21—21 of FIG. 20.

The standard bow can be modified to produce a fancy bow 44 shown in FIGS. 9 and 10. An additional section 46 is added to the section 20. This additional section 46 is shown in FIGS. 20 and 21. This additional section 46 is of the same size and shape as the section 20 in FIG. 3. However, the additional section 46 is not folded over but is a single layer of material. The additional section 46 will normally be constructed of precisely the same material of section 20. The additional section 46 could be created by longitudinally cutting in half a section 20. The additional section 46 includes cuts 48 which form a plurality of strips 50. These strips 50 again will be about an eighth of an inch wide. However, the strips 50 at the outer edge 52 are free or unattached relative to each other. The strips 50 extend from a border 54 which is directly adjacent the lower edge 56. The additional section 46 also includes a short in length left edge 58 and a longer in length right edge 60. It is to be understood that this additional section 46 is to be placed in abutment with section 20 shown in FIG. 3. When the combined sections 20 and 46 are wound in the same manner on the core 40, the fancy bow shown in FIGS. 9 and 10 will be produced. The winding is again held together by a collar 41.

Figure 11:
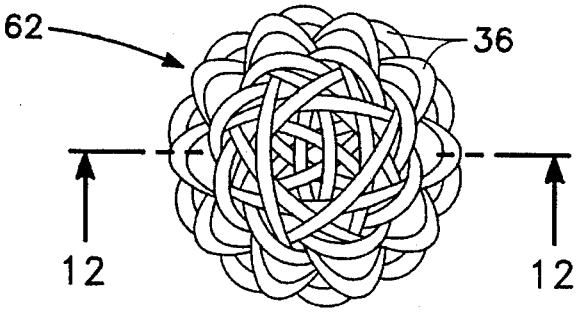
FIG. 11 is a top plan view of a different type of bow type of decorative ornament which is manufactured by winding of the folded trapezoidal shaped sheet material section by starting the winding on the core with the longer edge as opposed to the shorter edge which has occurred within FIGS. 7 and 9.
Figure 12:
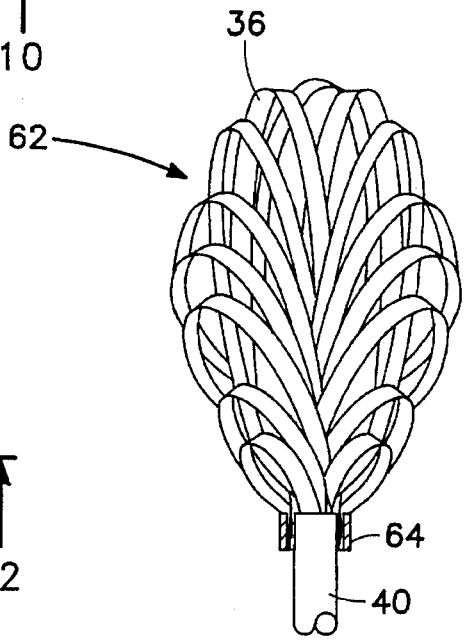
FIG. 12 is a cross-sectional view taken along line 12—12 of FIG. 11.
Figure 13:
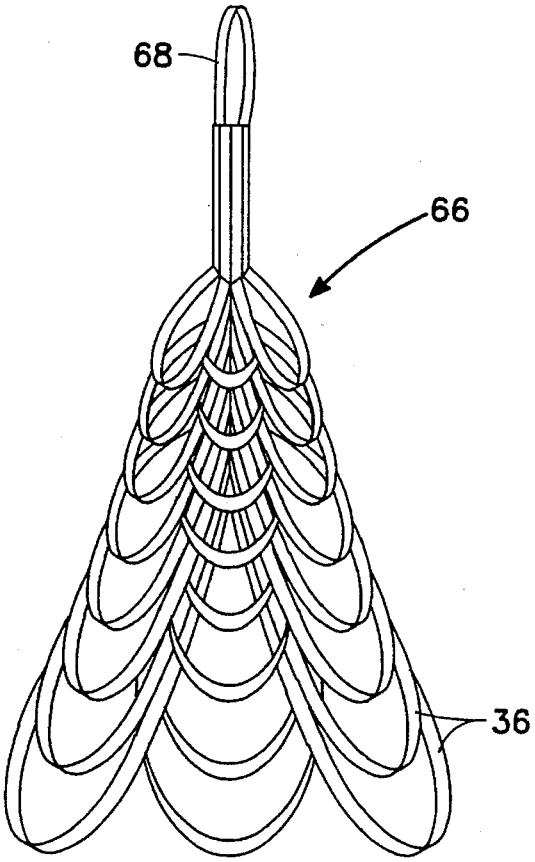
FIG. 13 is a side view of a bow that is constructed with the trapezoidal shaped section of sheet material by initiating the winding procedure with an edge of the trapezoidal shaped sheet material and winding such longitudinally along the core.

In order to produce the standard puff bow 62 shown in FIGS. 11 and 12, it is only necessary to do the same winding procedure for the standard bow 42 with the exception that the winding on the core 40 will start with the right edge 24 which is longer in length than the left edge 22. This will produce the different configuration of bow shown in FIGS. 11 and 12. It is to be understood that once the winding is completed, there is employed a collar 64 to securely fasten the edge 22 of the bow so that it will not be permitted to unwind. It is considered within the scope of this invention that the standard puff bows 62 shown in FIGS. 11 and 12 could also include an additional section 46 which would produce a slightly different configuration of puff bow (not shown).

Figure 15:
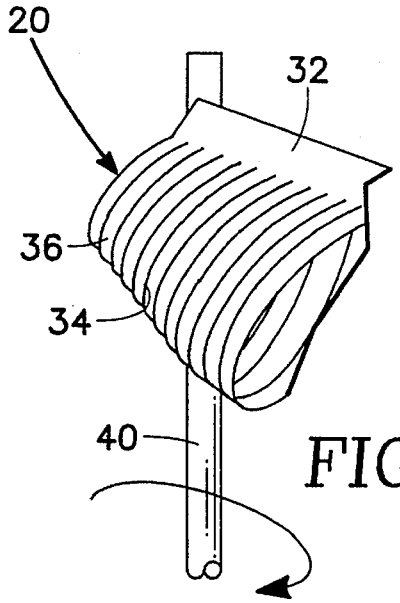
FIG. 15 is a view depicting winding of the borders of the trapezoidal shaped sheet material of FIG. 3 on a core where the winding occurs longitudinally along the core.

If the winding of the section 20 of FIG. 3 is accomplished longitudinally along the core 40 as opposed to a direct overlapping relationship as is depicted in FIG. 15, this will result in the production of a standard tree ornament 66. The winding is longitudinally spread out along core 40. It is to be understood that the edges 22 and 24 will be fixed by some means as by tape or adhesive to the core 40. Generally the standard tree ornament 66 includes a hanging loop 68 to facilitate securing of the hanging tree 66 to an appropriate exterior structure. Also, the standard tree ornament 66 could be mounted on a base (not shown).

Figure 14:
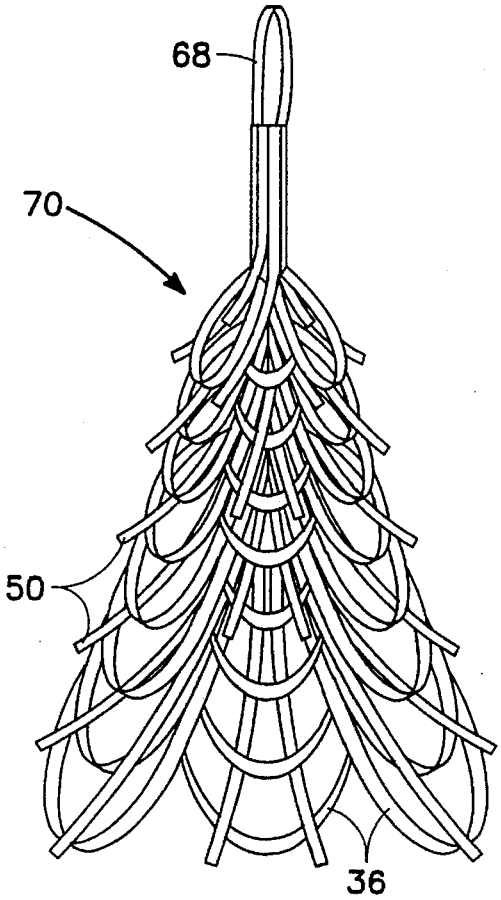
FIG. 14 is similar to FIG. 13 but where there has been included the additional section of sheet material which was previously discussed in relation to FIG. 9.

Referring particularly to FIG. 14 there is shown a fancy tree ornament 70. The fancy tree ornament 70 is constructed in precisely the same way as ornament 66 with the exception there is added the additional section 46 of FIG. 20.

Figure 17:
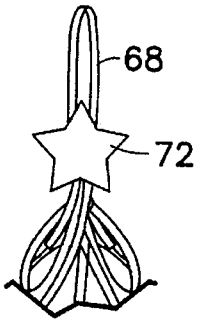
FIG. 17 is a view of the upper portion of the bow of FIG. 13 but which has been modified to include a stick ornament inserted within the core.

Within the standard tree ornament 66 and the fancy tree ornament 70, core 40 could be made to comprise a hollow tube. In that particular situation a separate ornament 72, which would be mounted on a thin piece of wire or plastic rod, could be mounted in conjunction with the standard tree ornament 66 or the fancy tree ornament 70. This separate ornament 72 is shown in FIG. 17. The wire or plastic rod of the separate ornament 72 would be inserted within the interior of the hollow core 40 which provides a means of mounting of the separate ornament 72.

Figure 18:
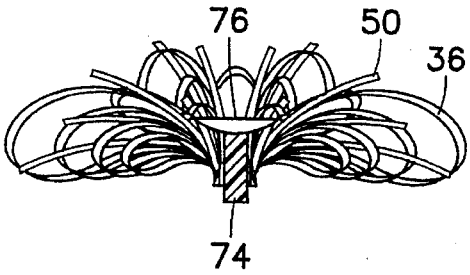
FIG. 18 is a cross-sectional view of the bow of FIG. 10 but showing a modified form of core which can be used to place different designs in conjunction with the bow.

Referring particularly to FIG. 18 there is shown a bow similar to the fancy bow 44. The difference is rather than being wound on just a solid or hollow core, there is utilized a core 74 of a special configuration. The core 74 includes a fixture 76. On the fixture 76 there may be included a type of indicia such as a decal or molded plastic which will result in the production of a ornament of a different configuration.

Figure 19:
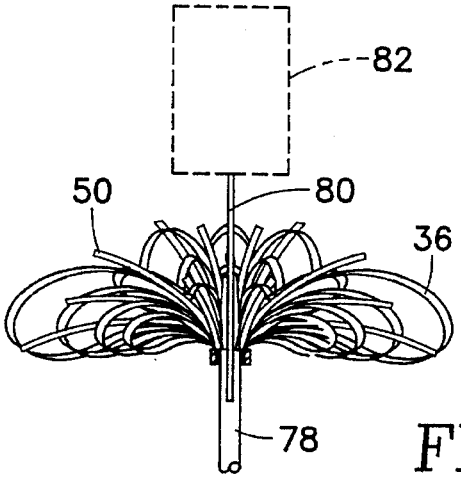
FIG. 19 is a view of the bow similar to FIG. 10 but showing the addition of a further decorative part that is to be inserted in conjunction with the core and located in the center of the bow.

Referring particularly to FIG. 19 there is shown a fancy bow similar to FIG. 10 with the exception that the core 78 is shown elongated, taking the form of a stick. The core 78 is to be hollow and is to be capable of receiving a wire or plastic rod 80 of a separate ornament 82. This separate ornament 82 could include a sculpture, drawing or words that would give a different appearance to the decorative ornament of the present invention.

What is claimed is:

1. The method of making a decorative ornament comprising the steps of:

utilizing an elongated rigid core which has a sidewall;

forming a first section of thin, sheet material which has a truncated cone shape where said first section has a pair of opposite parallel edges at different lengths and a pair of opposite oblique edges of the same length;

cutting said first section into a mass of thin strips producing cuts occurring in a direction parallel to said opposite parallel edges with said cuts terminating at solid, uncut borders directly adjacent each of the said opposite oblique edges;

folding said first section once upon itself forming a fold line that is perpendicular to said parallel edges and locating said solid, uncut borders in abutting juxtaposition producing a series of loops with there being a single loop located between directly adjacent cuts; and winding said borders several revolutions onto said sidewall producing said decorative ornament.

2. The method of making a decorative ornament as defined in claim 1 wherein:

within said forming step said opposite parallel edges comprise a short length edge and a long length edge, said winding step starts with said short length edge on said core.

3. The method of making a decorative ornament as defined in claim 2 wherein:

utilizing a second section of thin, sheet material which comprises a single layer of thin, sheet material similar in shape to said first section when folded upon itself said second section of thin, sheet material includes cuts resembling those in said first section forming a series of thin strips; and placing said second section in abutting juxtaposition with said first section prior to said winding step.

4. The method of making a decorative ornament as defined within claim 1 wherein:

within said forming step said opposite parallel edges comprise a short length edge and a long length edge, said winding step starts with said long length edge on said core.

5. The method of making a decorative ornament as defined in claim 4 wherein:

utilizing a second section of thin, sheet material which comprises a single layer of thin, sheet material which is similar in shape to said first section when folded upon itself said second section of thin, sheet material includes cuts resembling those in said first section forming a series of thin strips; and placing said second section in abutting juxtaposition with said first section prior to said winding step.

6. The method of making a decorative ornament as defined within claim 1 wherein:

utilizing a second section of thin, sheet material which comprises a single layer of thin, sheet material similar in shape to said first section when folded upon itself said second section of thin, sheet material includes cuts resembling those in said first section forming a series of thin strips; and placing said second section in abutting juxtaposition with said first section prior to said winding step.

7. The method of making a decorative ornament as defined in claim 6 wherein:

within said folding step locating said solid, uncut borders in a misaligned orientation relative to each other.

8. The method of making a decorative ornament as defined in claim 1 wherein:

within said folding step locating said solid, uncut borders in a misaligned orientation relative to each other.

9. The method of making a decorative ornament as defined in claim 1 wherein:

within said winding step the said several revolutions of said borders onto said sidewall of said core are accomplished in a direct overlapping relationship.

10. The method of making a decorative ornament as defined in claim 1 wherein:

within said winding step the said several revolutions of said borders onto said sidewall of said core are accomplished by wrapping said borders longitudinally along said sidewall.

11. The method of making a decorative ornament as defined in claim 10 wherein:

utilizing a second section of thin, sheet material which comprises a single layer of thin, sheet material similar in shape to said first section when folded upon itself with said second section including cuts resembling those in said first section forming a series of thin strips; and placing said second section in abutting juxtaposition with said first section prior to said winding step.

12. A decorative ornament comprising:

a rigid core; and a thin, sheet material section being in the shape of a truncated cone, a plurality of thin, flimsy, sheet material loops encompassing said core, said loops being formed from said section which includes a plurality of parallel cuts which are spaced apart, said cuts producing a plurality of strips, said strips extending between solid upper and lower borders, said loops being produced from said strips by folding of said section over upon itself placing said borders in juxtaposition, said borders being wound on said core with said borders being of sufficient length to have said borders to be wound a plurality of revolutions.

13. The decorative ornament as defined in claim 12 wherein:

said borders being wound in an overlapping arrangement.

14. The decorative ornament as defined in claim 12 wherein:

said borders being wrapped longitudinally along said core.

15. The decorative ornament as defined in claim 12 wherein:

a second section of sheet material comprising a single layer of sheet material which is similar in shape to said first section when folded upon itself, said second section of sheet material including cuts similar to said first section forming a series of thin strips having free outer ends, said second section to be placed in juxtaposition with said first section, both said first section and said second section being wound on said core.

16. The decorative ornament as defined in claim 12 wherein:

said borders being misaligned when wound on said core.

* * * * *